US007436297B1

(12) United States Patent
Tucker

(10) Patent No.: US 7,436,297 B1
(45) Date of Patent: Oct. 14, 2008

(54) SYSTEM AND METHOD FOR PROTECTING NETWORKED SECURITY DEVICES

(75) Inventor: James L. Tucker, Clearwater, FL (US)

(73) Assignee: Honeywell International Inc., Morristown, NJ (US)

( * ) Notice: Subject to any disclaimer, the term of this patent is extended or adjusted under 35 U.S.C. 154(b) by 265 days.

(21) Appl. No.: 11/372,504

(22) Filed: Mar. 10, 2006

(51) Int. Cl.
*G08B 13/00* (2006.01)

(52) U.S. Cl. ..... 340/541; 340/508; 340/531; 726/26

(58) Field of Classification Search ..... 340/545.6, 340/545.1, 568.1, 539.22, 539.26, 541, 550, 340/506, 508, 531, 533; 726/26, 27
See application file for complete search history.

(56) References Cited

U.S. PATENT DOCUMENTS 6,259,366 B1 * 7/2001 Lindskog et al. ..... 340/568.7
7,019,640 B2 * 3/2006 Canich et al. ..... 340/531
2001/0054964 A1 * 12/2001 Popp et al. ..... 340/584
2002/0014962 A1 * 2/2002 Miglioli et al. ..... 340/571
2004/0174259 A1 * 9/2004 Peel et al. ..... 340/539.26
2006/0071786 A1 * 4/2006 Fano ..... 340/539.22
2006/0220850 A1 * 10/2006 Bowser et al. ..... 340/568.1
2007/0115859 A1 * 5/2007 Meyers ..... 340/539.22
2007/0188322 A1 * 8/2007 English et al. ..... 340/539.26

* cited by examiner

*Primary Examiner*—Thomas J Mullen, Jr.
(74) *Attorney, Agent, or Firm*—McDonnell Boehnen Hulbert & Berghoff LLP

(57) ABSTRACT

A system for protecting a plurality of networked security devices is disclosed. The system includes a plurality of connectors, a plurality of security containers coupled together by the plurality of connectors, and a plurality of sensors, whereby at least one sensor of the plurality of sensors is disposed in at least one security container of the plurality of security containers, and the plurality of sensors are adapted to detect a threat to each security container of the plurality of security containers. The system also includes a plurality of monitoring devices, whereby each monitoring device of the plurality of monitoring devices is coupled to at least one sensor of the plurality of sensors, and the plurality of monitoring devices are adapted to monitor the plurality of sensors and activate protective measures in response to at least one detected threat.

16 Claims, 3 Drawing Sheets

SYSTEM AND METHOD FOR PROTECTING NETWORKED SECURITY DEVICES

GOVERNMENT LICENSE RIGHTS

The U.S. Government may have certain rights in the present invention as provided for by the terms of Government Contract # FA8650-04-C-8011 awarded by USAF.

TECHNICAL FIELD

The present invention generally relates to security systems and, in particular, to a system and method for improving the tamper protection provided by individual enclosures by the application of a network of security devices.

BACKGROUND

In both commercial and military applications, the possibility of another entity reverse engineering critical components is a danger to be avoided if possible. In commercial applications, businesses risk losing market share and money if another company is able to reverse engineer critical components. In military applications, governments risk losing battlefield advantages and soldiers' lives if critical system components are reverse engineered.

Recent advances in the technology for securing critical components include enclosing such components in anti-tamper containers (e.g., boxes, tubing, or other enclosures). These containers include sensors and monitoring devices that detect unauthorized attempts to open or circumvent the containers. If such an unauthorized attempt is detected, the monitoring devices activate appropriate responses to protect the components, such as erasing critical data and/or physically destroying the components. However, these anti-tamper containers do not provide a perfect solution, and they typically only delay the reverse engineering attempts made. Given enough time and opportunity, the security containers can be compromised, and the components and data reverse engineered. Therefore, it would be advantageous to provide a system and method for improving the anti-tamper protection provided by existing security containers. As described in detail below, the present invention provides a system and method, which increases the protection of critical components housed in networked security containers.

SUMMARY

The above-mentioned problems and other problems are resolved by the present invention and will be understood by reading and studying the following specification.

In accordance with a preferred embodiment of the present invention, a system for protecting a plurality of networked security devices is provided. The system includes a plurality of connectors, a plurality of security containers coupled together by the plurality of connectors, a plurality of sensors, whereby at least one sensor of the plurality of sensors is disposed in at least one security container of the plurality of security containers, and the plurality of sensors are adapted to detect a threat to each security container of the plurality of security containers. The system also includes a plurality of monitoring devices, whereby each monitoring device of the plurality of monitoring devices is coupled to at least one sensor of the plurality of sensors, and the plurality of monitoring devices are adapted to monitor the plurality of sensors and activate protective measures in response to at least one detected threat.

In accordance with a second embodiment, a method of monitoring a networked security device system is provided. The method includes the steps of setting a threat status for each security container of a plurality of security containers, transmitting the threat status of each security container to at least a second security container, activating at least one protective measure in at least one security container if a transmitted threat status for at least one of each security container of said plurality of security containers indicates a detected threat.

The details of various embodiments of the claimed invention are set forth in the accompanying drawings and the description below. Other features and advantages will become apparent from the description, the drawings, and the claims.

DRAWINGS

Like reference numbers and designations in the various drawings indicate like elements.

DETAILED DESCRIPTION

The present invention decreases the possibility that networked security containers which protect components and data can be accessed and circumvented, and increases the time required to compromise such security containers. The present invention provides these benefits by networking a plurality of security containers together in a way that enables the security containers to respond jointly to threats detected in a single container. This capability decreases the opportunities to compromise the network of security containers, with attacks on individual security containers. In addition, the networked security containers improve reliability of detecting true threats and not detecting false positives.

Figure 1:
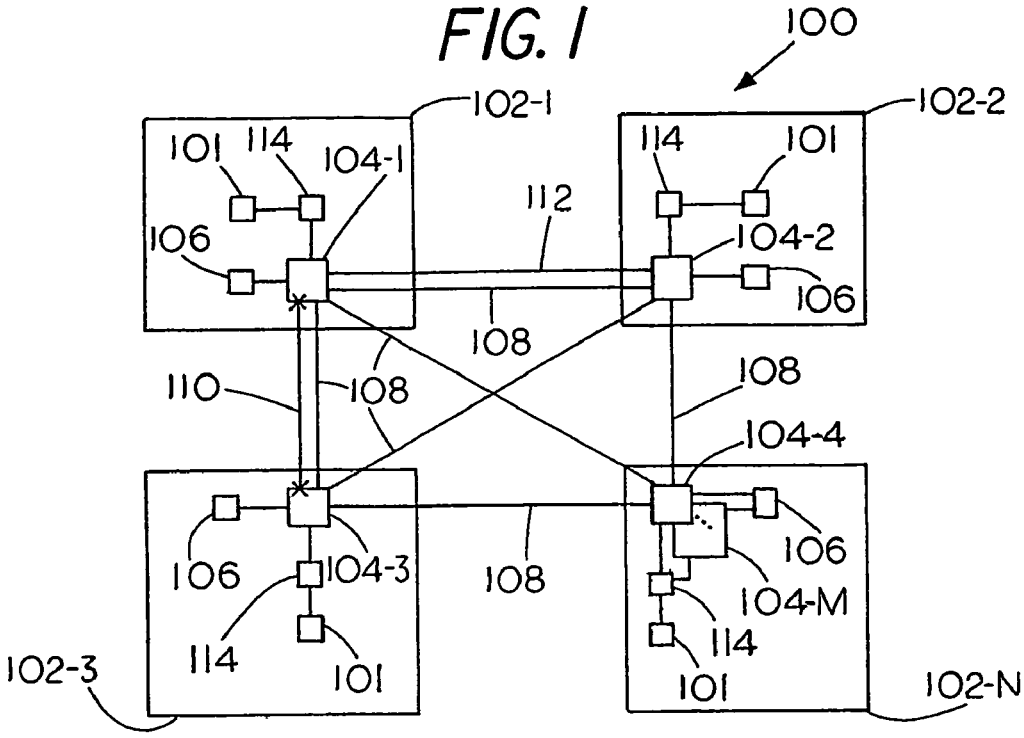
FIG. 1 is a block diagram of a system for protecting a plurality of networked security devices according to a preferred embodiment of the present invention.

With reference now to the figures, FIG. 1 is a block diagram of a system 100 for protecting a plurality of networked security devices according to a preferred embodiment of the present invention. For this example embodiment, system 100 includes a plurality of components 101 located inside of a plurality of security containers (e.g., boxes, tubing or other like enclosures) 102-1 . . . 102-N, where N is the total number of security containers. The primary function of each container 102-1 . . . 102-N is to protect the physical structure of components 101, and/or the data contained on components 101 from tampering and reverse engineering. For example, security containers 102-1 . . . 102-N are composed of any appropriate material that makes unauthorized access difficult, such as metals, metal-alloys, and sufficiently hard polymers or plastics. For this example embodiment, only one component 101 is shown in each of security containers 102-1 . . . 102-N, respectively. However, it is to be understood that, in a different embodiment, a plurality of components 101 can placed in security containers 102-1 . . . 102-N.

For this example embodiment, system 100 also includes a plurality of sensors 106 located in security containers 102-1 . . . 102-N. The primary function of each sensor of the plurality of sensors 106 is used to determine if an attempt is being made to open or circumvent the security container in which that sensor is located. For example, each sensor 106 can be implemented with any appropriate sensor that can detect a tampering attempt (also referred to as detecting a threat). Such sensors can include, but are not limited to, magnetic sensors, tortional sensors, optical sensors, and any other existing or later developed sensor technology that can detect tampering.

Notably, although only one sensor 106 is shown in each of security containers 102-1 . . . 102-N, it is to be understood that the present invention is not intended to be so limited, and can include within its scope any appropriate number of sensors that can be used in each of security containers 102-1 . . . 102-N. Also, as an alternative, at least one of the sensors 106 can be used as a backup sensor in the event that a primary sensor fails. As another alternative, each of the plurality of sensors can detect different aspects of tampering attempts in other configurations with a plurality of sensors 106 in each of security containers 102-1 . . . 102-N.

For this example embodiment, system 100 also includes a plurality of monitoring devices 104-1 . . . 104-M, where M is the total number of monitoring devices. In this example embodiment, at least one of the plurality of monitoring devices 104-1 . . . 104-M is located in each security container 102-1 . . . 102-N. Notably, although only one monitoring device 104-1 . . . 104-3 is shown in each of security containers 102-1 . . . 102-3, the present invention is not intended to be so limited and can include within its scope any suitable number (e.g., 1, 2, 3 . . . , etc.) of monitoring devices 104-1 . . . 104-M located in each security container 102-1 . . . 102-N. For example, in this exemplary figure, a plurality of monitoring devices 104-4 . . . 104-M are located in security container 102-N. The plurality of monitoring devices 104-4 . . . 104-M provide redundant monitoring of sensor 106 in security container 102-N and redundant communication with monitoring devices 104-1 . . . 104-3 in security containers 102-1 . . . 102-3.

As an alternative, at least one of the plurality of monitoring devices 104-1 . . . 104-M can be used as a backup in the event that a primary monitoring device fails. For example, if monitoring device 104-1 fails, monitoring device 104-2 can be used to continue monitoring for detected threats in security container 102-1. Such capability improves the reliability of system 100 by providing redundancy in detection of threats. It also reduces the number of false positives detected through comparison of redundant monitoring by monitoring devices 104-1 . . . 104-M.

In any event, each monitoring device 104-1 . . . 104-M is coupled to the other monitoring devices for data communications via connectors 108. Monitoring devices 104-1 . . . 104-M are coupled to each other via connectors 108 using dedicated ports in a preferred embodiment. Alternatively, monitoring devices 104-1 . . . 104-M can share ports with other components using techniques known to one of skill in the art such as time-division multiplexing.

For this example embodiment, each monitoring device of the plurality of monitoring devices 104-1 . . . 104-M can detect a security threat sensed by a monitoring sensor 106. For example, each monitoring device 104-1 . . . 104-M can monitor a sensor 106 located in the same security container as that monitoring device. In a different embodiment, each monitoring device 104-1 . . . 104-M can monitor a sensor 106 located in a different security container, by coupling a monitoring device in the first security container to a sensor located in the second security container via the monitoring device located in the second security container.

For this example embodiment, each monitoring device 104-1 . . . 104-M can respond to a detected threat by activating one or more protective measures. Such protective measures can include, but are not limited to, erasing critical data on components 101, overwriting critical data on components 101, and physically destroying components 101. In a preferred embodiment, each monitoring device 104-1 . . . 104-M activates protective measures locally in the security container where that monitoring device is located. As an alternative, in a different embodiment, each monitoring device 104-1 . . . 104-M can activate protective measures in other security containers via connectors 108. This capability provides an additional level of security, because security measures can still be activated even if a local monitoring device is disabled or fails.

For this example embodiment, each monitoring device 104-1 . . . 104-M is coupled to the monitoring devices located in other security containers via connectors 108, which forms a distributed network configuration. This configuration provides multiple communication paths between each of monitoring devices 104-1 . . . 104-M and enables communication between monitoring devices 104-1 . . . 104-M to continue even if one of the connectors 108 fails. As such, each connector 108 can be implemented with any suitable medium for carrying signals and/or data, such as, for example, optical fiber, coaxial cable, twisted pair copper wire, and wireless radio links. The distributed network configuration used can be implemented with full-duplex channels, half-duplex channels, or simplex channels.

In operation, in accordance with an example embodiment of the present invention, each sensor 106 detects an attempt to tamper with, access or circumvent a security container 102-1 . . . 102-N. Each sensor 106 is coupled to a monitoring device 104-1 . . . 104-M located in the same security container as that sensor. Each monitoring device 104-1 . . . 104-M is adapted to transmit threat status signals to each of the other monitoring devices based on signals received from the sensor located in the same security container as that monitoring device 104-1 . . . 104-M. The threat status signals indicate that a tamper attempt has been detected. In a preferred embodiment, each monitoring device 104-1 . . . 104-M actively transmits a threat status signal to the other monitoring devices once a tamper attempt has been detected. Alternatively, each monitoring device 104-1 . . . 104-M can wait for a request from another monitoring device before transmitting a threat status signal. As another alternative, each monitoring device 104-1 . . . 104-M can be adapted to continuously transmit a signal whether or not a sensor 106 has detected a tamper attempt. In this case, if a signal is not received from a given monitoring device for a specified period of time, the remaining monitoring devices interpret the lack of a signal as a detected tamper attempt.

Since each monitoring device 104-1 . . . 104-M is coupled to the other monitoring devices and can transmit threat status signals, each monitoring device 104-1 . . . 104-M is made aware of possible tampering with each security container 102-1 . . . 102-N. As such, for this example embodiment, each monitoring device 104-1 . . . 104-M can activate local protective measures based on threats detected by a sensor 106 located in another security container based on the threat status signals received from other monitoring devices. Also, each monitoring device 104-1 . . . 104-M can activate protective measures by sending a signal to instruct protective device 114 to perform protective measures. For example, protective device 114 can be implemented as a field programmable gate array (FPGA) that can alter data on components 101. As another example, protective device 114 can be implemented as a thermal battery that can be used to physically destroy the components involved. In any event, it should be understood that protective device 114 can be implemented as any suitable device that can be used to alter data and/or destroy the physical components involved. Additionally, it should be understood that, in some applications, each monitoring device 104-1 . . . 104-M can be adapted to directly alter data on components 101 and/or physically destroy those components.

Hence, the present invention provides improved system security since individual components of a system cannot be easily isolated and attacked separately. Tampering with a security container 102-1 . . . 102-N activates protective measures in that security container and all of the other networked security containers. As an alternative, each monitoring device 104-1 . . . 104-M can activate local protective measures discriminately based on predetermined criteria. For example, rather than activating local protective measures in all networked security containers 102-1 . . . 102-N, local protective measures can be activated only in those security containers that house related or similar components as those housed in the security container where a tamper attempt has been detected.

In a preferred embodiment of the present invention, if local protective measures are to be activated in all of security containers 102-1 . . . 102-N, only a two state variable is needed for the threat status signal to indicate whether or not a threat has been detected. However, the present invention is not intended to be so limited and the threat status signals used can include various types of data. For example, as an alternative, threat status signals can be used to indicate not only if a threat has been detected, but can also be used to indicate additional information, such as which sensor detected the threat, the type of threat, etc. This additional information can be useful to enable each monitoring device 104-1 . . . 104-M to vary which protective measures to activate and to discriminately determine when to activate local protective measures.

Additionally, each monitoring device 104-1 . . . 104-M can perform a check for a false indication of a threat (i.e. false positive). This check can include, but is not limited to, sending a request for a confirmation signal and waiting a predetermined amount of time prior to activating protective measures for the confirmation signal to be received. Alternatively, each monitoring device 104-1 . . . 104-M can perform this check by comparing threat status signals received over different communications paths but originating from the same monitoring device. If the signals are the same, monitoring devices 104-1 . . . 104-M can consider the threat status confirmed. If the signals are different, monitoring devices 104-1 . . . 104-M can perform additional analyses and checks. As such, it should be understood that the present invention is not to be limited to a particular technique used in checking for false indications of a threat, and that any appropriate check can be implemented with monitoring devices 104-1 . . . 104-M. In any event, the reliability of system 100 is improved by enabling checks for false positives via the plurality of monitoring devices 104-1 . . . 104-M.

For this example embodiment, each monitoring device 104-1 and 104-2 is also coupled to the other via a redundant connector 112. Redundant connector 112 enables monitoring devices 104-1 and 104-2 to convey data and/or signals using multiple communication paths. In a preferred embodiment, redundant connector 112 provides a back-up communication path and check for false alarms. For example, if monitoring device 104-2 does not receive a signal from monitoring device 104-1, rather than immediately interpreting the lack of a signal as a detected tamper attempt, monitoring device 104-2 uses redundant connector 112 to verify the status of monitoring device 104-1. Additionally, if the communication path along a connector 108 is disabled, a redundant communication path along redundant connector 112 enables communications between monitoring devices 104-1 and 104-2 to continue. Notably, although only monitoring devices 104-1 and 104-2 are shown redundantly connected in this example embodiment, the present invention is not intended to be so limited, and any or all of monitoring devices 104-1 . . . 104-M can be redundantly connected to another monitoring device via additional redundant connectors 112.

For this example embodiment, as an additional security measure, the physical movement of security containers 102-1 . . . 102-N is limited due to the length and placement of connectors 108. The length and placement of connectors 108 is such that each security container 102-1 . . . 102-N is substantially immovable without breaking the connection between monitoring devices 104-1 . . . 104-M. A break in a connection between monitoring devices 104-1 . . . 104-M causes monitoring devices 104-1 . . . 104-M to activate local protective measures. Additionally, connectors 108 can be wrapped around security containers 102-1 . . . 102-N to further increase the difficulty of unauthorized access to the components inside security containers 102-1 . . . 102-N.

Also, for this example embodiment, a decoy connector 110 can be used to further enhance the security of the networked system. Decoy connector 110 couples monitoring devices 104-1 and 104-3. In a preferred embodiment, decoy connector 110 carries a false signal to give an intruder the impression that decoy connector 110 is an actual connector 108. In other words, decoy connector 110 can be used to confuse those who attempt to tamper with, access or circumvent the security measures of security containers 102-1 . . . 102-N. For example, if an attempt is made to reverse engineer the signals produced by monitoring devices 104-1 . . . 104-M, decoy connector 110 provides false data which can frustrate those reverse engineering attempts. Notably, although only monitoring devices 104-1 and 104-3 are shown coupled together by decoy connector 110 in this example embodiment, the present invention is not intended to be so limited, and it should be understood that any or all of monitoring devices 104-1 . . . 104-M can be coupled to one another via additional decoy connectors 110.

Figure 2:
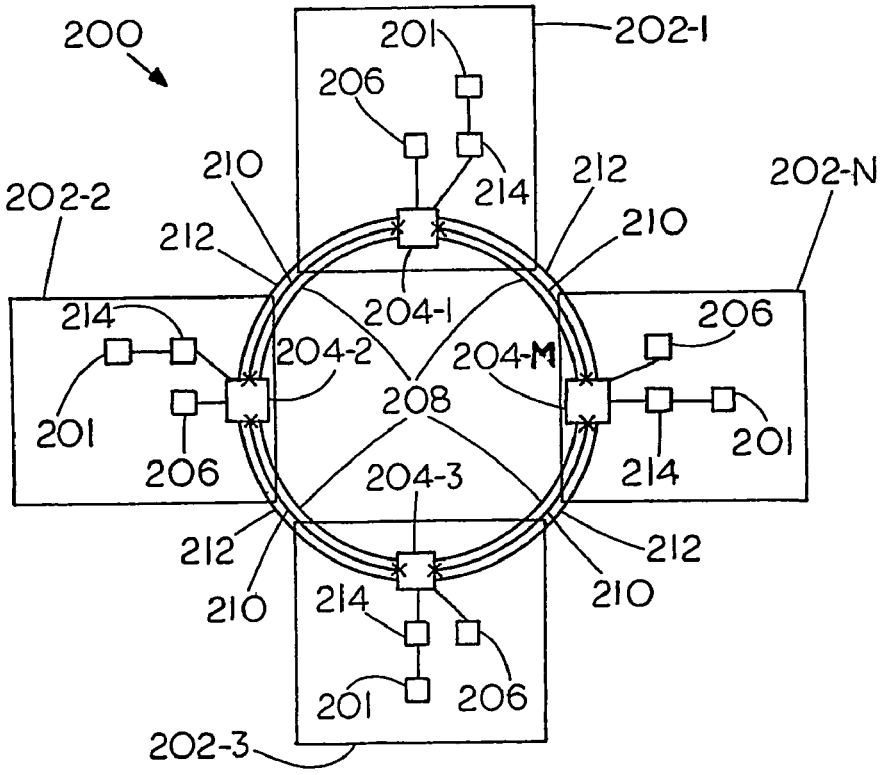
FIG. 2 is a block diagram of a system for protecting a plurality of networked security devices according to a second example embodiment of the present invention.

FIG. 2 is a block diagram of a system 200 for protecting a plurality of networked security devices according to a second example embodiment of the present invention. For this example embodiment, system 200 includes a plurality of security containers 202-1 . . . 202-N, a plurality of sensors 206, a plurality of monitoring devices 204-1 . . . 204-M, a plurality of protective devices 214, a plurality of connectors 208, a plurality of redundant connectors 212, and a plurality of decoy connectors 210. Each of these elements shown in FIG. 2 functions as described above with respect to like numbered elements shown in FIG. 1. As shown in FIG. 2, monitoring devices 204-1 . . . 204-M are coupled together in a ring network configuration. Thus, in operation, each monitoring device 204-1 . . . 204-M can combine local threat status data provided by a respective sensor 206, with threat status signals received from one or more neighboring monitoring device, into a combined signal. Each monitoring device 204-1 . . . 204-M can pass the combined threat status signals to one or more other neighboring monitoring devices in the ring configuration using known ring network configuration techniques. For example, the ring configuration used can be implemented with full-duplex channels, half-duplex channels, or simplex channels.

Figure 3:
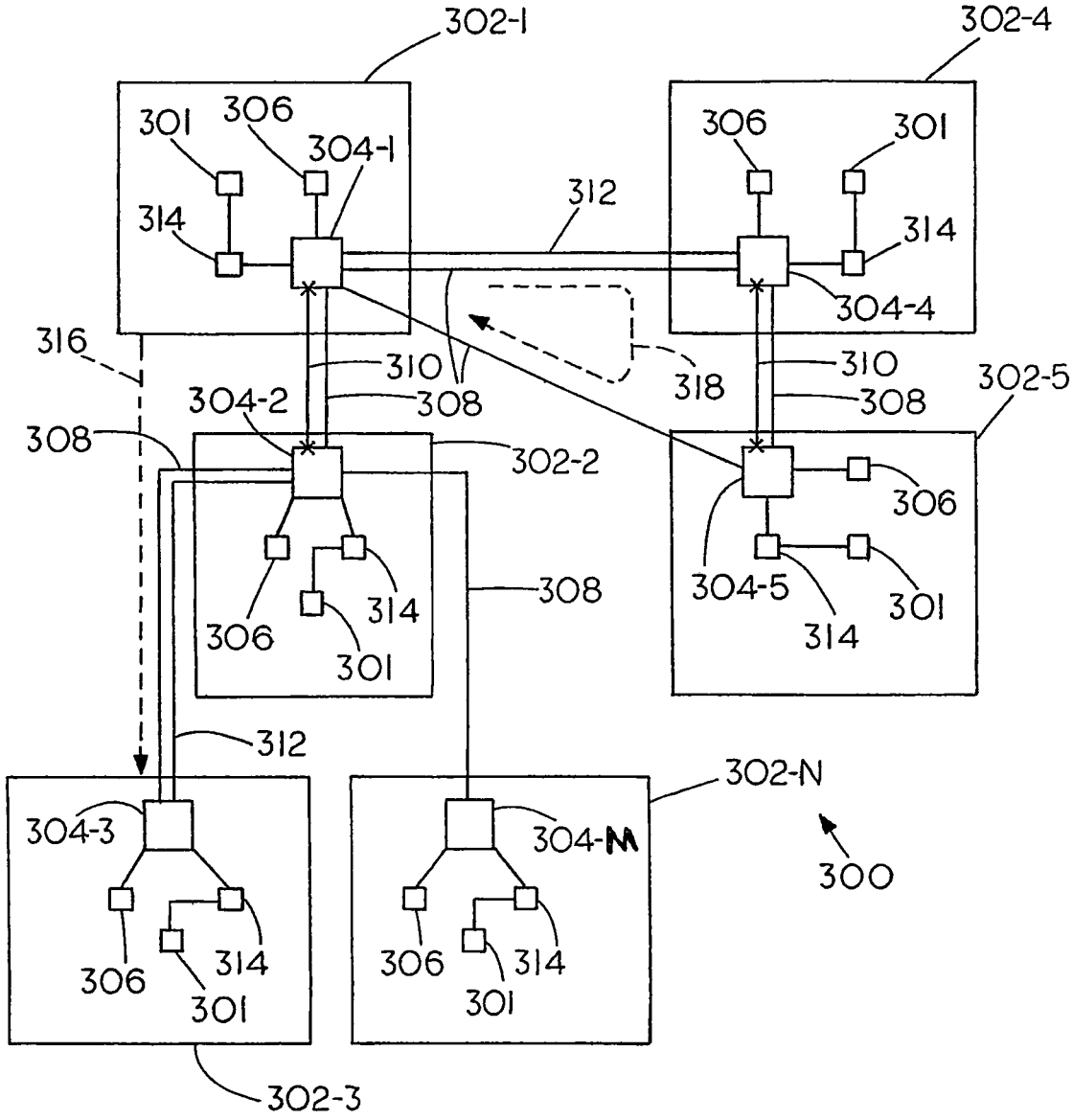
FIG. 3 is a block diagram of a system for protecting a plurality of networked security devices according to a third example embodiment of the present invention.

FIG. 3 is a block diagram of a system 300 for protecting a plurality of networked security devices according to a third example embodiment of the present invention. For this example embodiment, system 300 includes a plurality of security containers 302-1 . . . 302-N, a plurality of sensors 306, a plurality of monitoring devices 304-1 . . . 304-M, a plurality of protective devices 314, a plurality of connectors 308, a plurality of redundant connectors 312, and a plurality of decoy connectors 310. Each of these elements shown in FIG. 3 functions as described above with respect to like numbered elements shown in FIGS. 1 and 2. As shown in FIG. 3, monitoring devices 304-1 . . . 304-M are coupled together in an unstructured network configuration. An unstructured network configuration, as described herein, refers to a network configuration that does not require communication paths to be able to complete a circle (i.e., ending at their starting point). For example, communication path 316 starts at monitoring device 304-1 and ends at monitoring device 304-3 via monitoring device 304-2, and communication path 318 goes from monitoring device 304-1 to monitoring device 304-4, to monitoring device 304-5, and back to monitoring device 304-1. Thus, each monitoring device 304-1 . . . 304-M can pass combined threat status signals to one or more other neighboring monitoring devices in the unstructured network configuration using known unstructured network configuration techniques. Also, the unstructured network configuration used can be implemented with full-duplex channels, half-duplex channels, or simplex channels.

Figure 4:
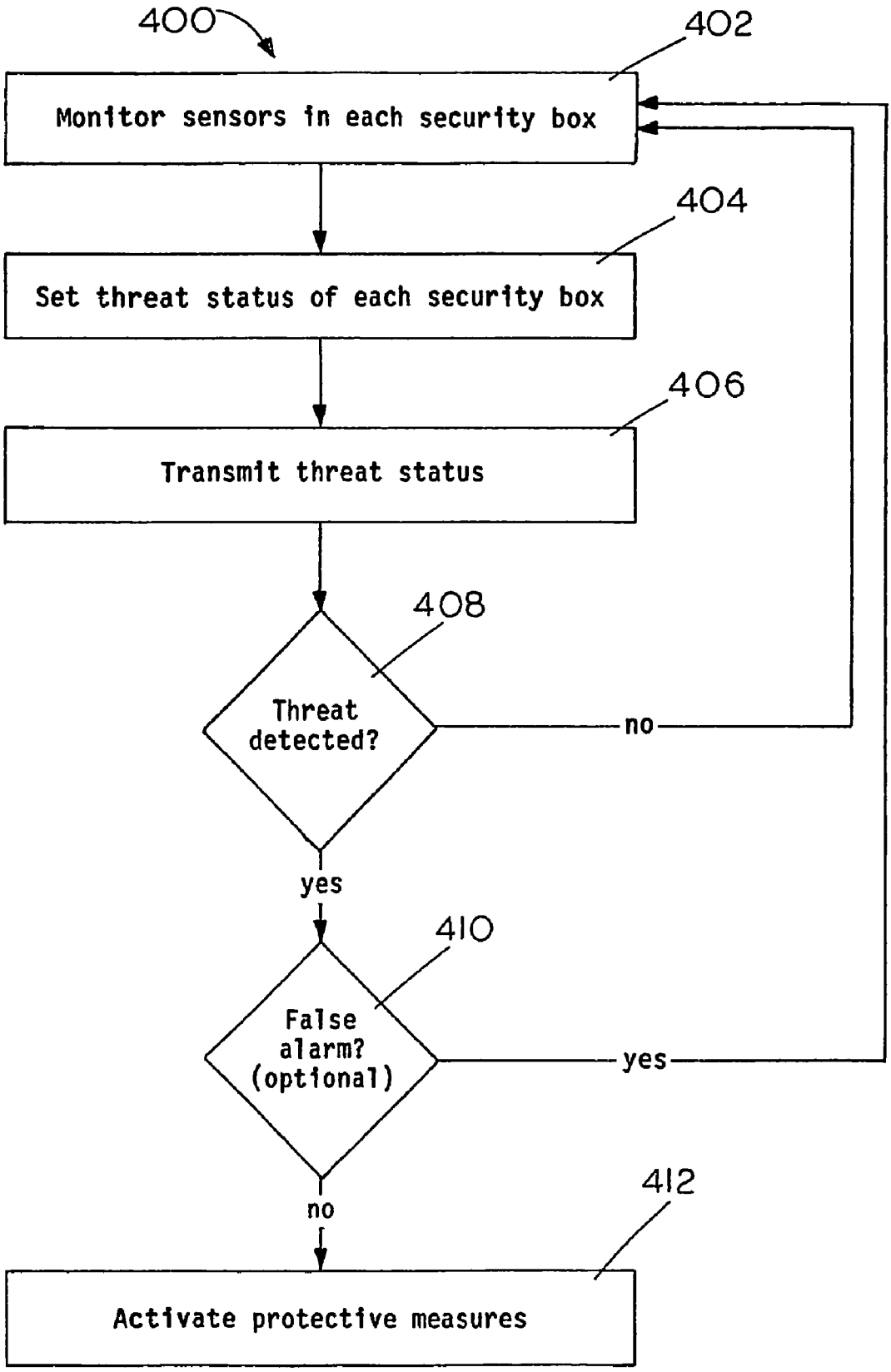
FIG. 4 is a flow chart showing a method for monitoring a system for protecting a plurality of networked security device according to a preferred embodiment of the present invention.

FIG. 4 is a flow chart showing a method 400 for monitoring a plurality of networked security devices, such as the security devices described above with respect to FIGS. 1-3. At step 402, a plurality of monitoring devices (e.g., monitoring devices 104 in FIG. 1) monitor a plurality of sensors (e.g., sensors 106) in a plurality of security containers (e.g., security containers 102). The sensors detect threats to the security containers, such as an attempt to open a security container, an attempt to insert wires or cabling into a security container, and an attempt to scan the contents of a security container, etc. If a sensor detects a threat, that sensor sends a signal to the corresponding monitoring device. At step 404, that corresponding monitoring device sets the threat status of that security container to indicate a threat has been detected. As described above, the threat status can be a two state variable (e.g., bit) indicating whether a threat has been detected or not. Alternatively, the threat status can contain additional data, such as, for example, the type of threat detected. If (at step 404) the sensor in a given security container does not detect a threat, the monitoring device monitoring that sensor sets the threat status of that security container to indicate that no threat has been detected.

At step 406, each monitoring device transmits a threat status signal to other monitoring devices indicating the threat status of the security container corresponding to each of the monitoring devices. As described above, in a preferred embodiment, the monitoring devices are coupled together in a distributed network and can transmit the threat status to the other monitoring devices using a plurality of communication paths. Alternatively, the monitoring devices can be coupled together in different network configurations, such as, for example, a ring configuration or unstructured network configuration, as described above. In other words, it should be understood that the monitoring devices can be coupled together in any suitable network configuration. Also, each monitoring device automatically and periodically transmits a threat status signal to the other monitoring devices. However, as an alternative, each monitoring device can wait for a request signal to be received from other monitoring devices prior to transmitting a threat status signal.

At step 408, each monitoring device determines if a sensor has detected a threat in any of the networked security containers based on the threat status signals received from the other monitoring devices. For example, a determination about whether a threat has been detected can include checking for tampering with links between each of the monitoring devices. If a sensor detects tampering with a link (e.g., no signal is received from an associated monitoring device over any communication path), such tampering is considered a detected threat to the networked security system and treated the same as a detected threat to a security container. If the monitoring devices do not determine that a sensor has detected a threat in any security container, method 400 returns to step 402, where the monitoring devices in each security container continue to monitor the sensors for detected threats.

If (at step 408) a monitoring device determines that a sensor has detected a threat in at least one of the security containers, at step 410, each monitoring device can perform a check to determine if the detected threat is a false indication of a threat (i.e., false alarm or false positive). For example, the monitoring devices can perform this check by requesting a confirmation signal from the monitoring device which transmitted the signal indicating a detected threat. As another example, the monitoring devices can communicate with the monitoring device that transmitted the signal indicating a detected threat via a different network communication path, as described above. As another example, at least one other remote monitoring device can directly monitor the local sensor in the security box where a threat was detected by the local monitoring device. It is then determined if a true threat has been detected or not based on a comparison between what the remote and local monitoring devices determine upon monitoring the same local sensor. In any event, the reliability of the networked system is improved by enabling checks via the plurality of monitoring devices.

If (at step 410) the monitoring devices determine that a detected threat is not a false alarm, at step 412, each monitoring device responds locally by activating protective measures in its local security container. As an alternative, only some of the monitoring devices activate local protective measures based on predetermined criteria, such as, for example, the type of threat detected, the components being protected in each security container, etc. As yet another alternative, the monitoring devices can activate protective measures locally and/or in other security containers. Such protective measures can include, but are not limited to, erasing critical data, overwriting critical data, and physically destroying components involved. Finally, it should be understood that one or more steps of method 400 can occur simultaneously. For example, the monitoring devices can transmit current threat status signals (at step 406) while continuing to monitor sensors for newly detected threats (at step 402).

In summary, by networking a plurality of monitoring devices, the present invention provides improved security of components by increasing the difficulty and penalty of attempts to circumvent the protection of security containers on an individual basis. Since all (or at least some of) the monitoring devices respond to a detected threat in any security container, the possibility that an intruder will be able to bypass a security container is reduced.

A number of embodiments of the invention defined by the following claims have been described. Nevertheless, it will be understood that various modifications to the described embodiments may be made without departing from the spirit and scope of the claimed invention. Accordingly, other embodiments are within the scope of the following claims.

What is claimed is:

1. A networked security device system, comprising:

a plurality of connectors;

a plurality of security containers;

at least one sensor adapted to detect a threat to at least one security container of said plurality of security containers; and a plurality of monitoring devices disposed in the plurality of security containers and operatively coupled together by said plurality of connectors, at least one of the plurality of monitoring devices further operatively coupled to the at least one sensor and adapted to send a signal to at least a second monitoring device indicating a threat detected by the at least one sensor, wherein each of the plurality of monitoring devices is adapted to activate protective measures in response to a signal indicating a threat detected by the at least one sensor.

2. The system of claim 1, wherein said plurality of connectors comprise at least one of a fiber optic cable, coaxial cable, wireless data link, and a twisted pair of copper wires.

3. The system of claim 1, wherein the plurality of monitoring devices are operatively coupled together in at least one of a distributed network configuration, a ring network configuration, and an unstructured network configuration.

4. The system of claim 1, wherein the plurality of connectors comprise at least one decoy connector.

5. The system of claim 1, wherein each of the plurality of monitoring devices is adapted to activate at least one local protective measure in response to a threat detected in a different security container.

6. The system of claim 1, wherein each of the plurality of monitoring devices is adapted to activate at least one protective measure comprising at least one of overwriting critical data, erasing critical data, and physically destroying components.

7. The system of claim 1, wherein said plurality of monitoring devices are coupled together via the plurality of connectors such that the physical movement of the plurality of security containers housing the plurality of monitoring devices is limited due to the length and placement of the plurality of connectors.

8. The system of claim 1, further comprising:

at least one protective device operatively coupled to at least one monitoring device, wherein the at least one monitoring device sends control signals to the at least one protective device to activate protective measures.

9. The system of claim 8, wherein the at least one protective device further comprises at least one of a field programmable gate array, and a thermal battery.

10. A networked security device system, comprising:

means for detecting a threat in at least one security container of a plurality of security containers;

means for communicating said threat detected in said at least one security container to at least a second security container of said plurality of security containers; and means, responsive to the means for communicating, for activating at least one protective measure in each security container of said plurality of security containers if a threat is detected for any security container.

11. A method of manufacturing a networked security device system, the method comprising the steps of:

placing a plurality of components to be protected inside a plurality of security containers;

placing a plurality of monitoring devices inside the plurality of security containers; and redundantly coupling at least one monitoring device disposed inside at least one security container to at least a second monitoring device disposed inside at least a second security container using a plurality of connectors.

12. The method of manufacturing of claim 11, wherein the step of coupling at least a first monitoring device to at least a second monitoring device further comprises the steps of:

coupling at least one monitoring device disposed inside at least one security container to at least a second monitoring device disposed in at least a second security container; and forming at least one of a distributed network, a ring network, and an unstructured network.

13. A method of monitoring a networked security device system, the method comprising the steps of:

determining a threat status for at least one of a plurality of security containers;

transmitting the threat status of the at least one security container to at least a second security container of the plurality of security containers; and activating at least one protective measure in at least one of the plurality of security containers if the transmitted threat status indicates a detected threat.

14. The method of claim 13, wherein the activating step further comprises the step of:

activating at least one protective measure locally in each security container of said plurality of security containers if the transmitted threat status indicates a detected threat in any of the plurality of security containers.

15. The method of claim 13, wherein the activating step further comprises the step of:

checking for a false indication of a threat prior to activating the at least one protective measure.

16. The method of claim 13, wherein the activating step further comprises at least one step of:

overwriting critical data;

erasing critical data; and physically destroying a plurality of critical components.

* * * * *